United States Patent [19]

Konig et al.

[11] Patent Number: 4,812,993

[45] Date of Patent: Mar. 14, 1989

[54] METHOD AND MEANS FOR CONTROLLING THE DRAFTING OF SLIVER IN A DRAW FRAME

[75] Inventors: Herbert Konig, Ebersbach; Gerhard Stahle, Adelberg, both of Fed. Rep. of Germany

[73] Assignee: Zinser Textilmaschinen GmbH, Ebersbach, Fed. Rep. of Germany

[21] Appl. No.: 57,949

[22] Filed: Jun. 4, 1987

[30] Foreign Application Priority Data

Jun. 7, 1986 [DE] Fed. Rep. of Germany ..... 3619248

[51] Int. Cl.[4] ..... G01B 13/04; D01H 5/52

[52] U.S. Cl. ..... 364/470; 19/239; 19/300

[58] Field of Search ..... 364/468, 470; 19/239, 19/240, 300

[56] References Cited

U.S. PATENT DOCUMENTS 4,267,620 5/1981 Allen, Jr. ..... 19/239

4,302,968 12/1981 Moser ..... 19/239 X 4,646,387 3/1987 Oswald et al. ..... 19/240 X

*Primary Examiner*—Allen MacDonald

*Attorney, Agent, or Firm*—Shefte, Pinckney & Sawyer

[57] ABSTRACT

A method and means for controlling the drafting of sliver in a draw frame using sensing means with the aid of which variations in mass of the sliver can be sensed and a resulting signal applied to drafting means located after the sensing means in the direction of travel of the sliver and which changes the draft to compensate for sensed variations in the sliver mass. The sensing means and the drafting means are connected to controlling means which include a storage device. A sensed variation in sliver mass is temporarily stored by the storage device for the duration of a delay time which takes into consideration the traveling time of the sliver form the sensing means to the drafting means. The delay time is shortened by a correction time as a function of the magnitude and/or rate of the sensed variation in sliver mass. This has the effect that variations in mass of the sliver can be compensated almost completely by the drafting device.

10 Claims, 2 Drawing Sheets

METHOD AND MEANS FOR CONTROLLING THE DRAFTING OF SLIVER IN A DRAW FRAME

BACKGROUND OF THE INVENTION

The present invention relates to a method and means for controlling the drafting of sliver in a draw frame in which sliver first travels past sensing means that senses variations in the mass of sliver and then through drafting means located after the sensing means and whose draft can be changed in order to compensate for variations in mass, wherein a delay time in activation of the drafting means change is provided to account for the travel time of sliver from the sensing means to the drafting means.

In such prior known control methods and means, the control means is connected to the sensing means and to the drafting means and includes an information storage capability. Thus, if a variation in mass occurs in the sliver traveling past the sensing means, e.g. due to the sudden lack of one of several feed slivers, then the sensed value of the variation in mass is temporarily stored by the control means and after passage of a delay time corresponding to the travel time of the sliver from the sensing means to the drafting means, the control means changes the draft of the drafting means in accordance with the temporarily stored value. In such known devices, suddenly occurring variations in mass cannot be followed rapidly enough by the parts which drive the drafting means to effect accurate correspondence between the variation in mass and the imposed variation in drafting.

SUMMARY OF THE INVENTION

The present invention is directed to providing a method and means for better controlling drafting in conformance with variations, particularly sudden variations, in the mass of sliver. This is accomplished by an improvement in the method of the initially mentioned type by determining the delay time by subtracting from the travel time a correction time determined as a function of the sensed variation in the characteristic of sliver mass.

As a result of this shortening of the delay time, the changing of the draft of the drafting means is started slightly before the variation in mass of the sliver reaches the drafting means. This has the consequence that the parts which drive the drafting means can follow the variation in mass characteristic considerably better, so that overall compensation for the variation in mass can be almost completely accomplished.

In one form of the method of the invention the correction time is determined as a function of the sensed rate of change of the mass of sliver. In another form the correction time is determined as a function of the magnitude of the change of mass of sliver. In a third form the correction time is determined as a function of both the rate and the magnitude of change of mass of the sliver.

A further development of the method of the invention provides varying the rate of drafting variation in response to the magnitude of sliver mass characteristic variation sensed by said sensing. It is possible by means of this step for the parts which drive the drafting device to follow the sensed variation in mass characteristic even more precisely.

The controlling means of the present invention is incorporated in an apparatus for controlling the drafting of sliver in a draw frame. The apparatus includes means for sensing variations in mass characteristics of traveling sliver in advance of drafting means. Means are provided for varying the drafting means as a function of the variation in the sliver mass characteristic sensed by the sensing means. The controlling means varies the drafting means in response to a time delay corresponding to the time of travel of sliver from the sensing means to the drafting means, with the controlling means including means for determining a correction time as a function of the variation in the characteristic of sliver mass sensed by the sensing means and subtracting the correction time from the travel time to determine the delay time.

In one form of the controlling means, the correction time determining means determines the correction time as a function of the rate of change of mass of sliver. In another form the correction determining means determines the correction time as a function of the magnitude of the change of mass of sliver sensed by the sensing means. In a third form means are included for varying the rate of drafting variation in response to the magnitude of sliver mass characteristic variation sensed by the sensing means.

Preferably, the correction time determining means and the means for varying the rate of drafting variation are included in an electronic microprocesor. This measure permits a rapid and precise calculation of the delay time and control of the drafting device as a function of the sensed variation in mass.

Other features and advantages of the invention are apparent from the accompanying illustrations and the following detailed description.

DETAILED DESCRIPTION OF THE PREFERRED EMBODIMENT

Figure 1:
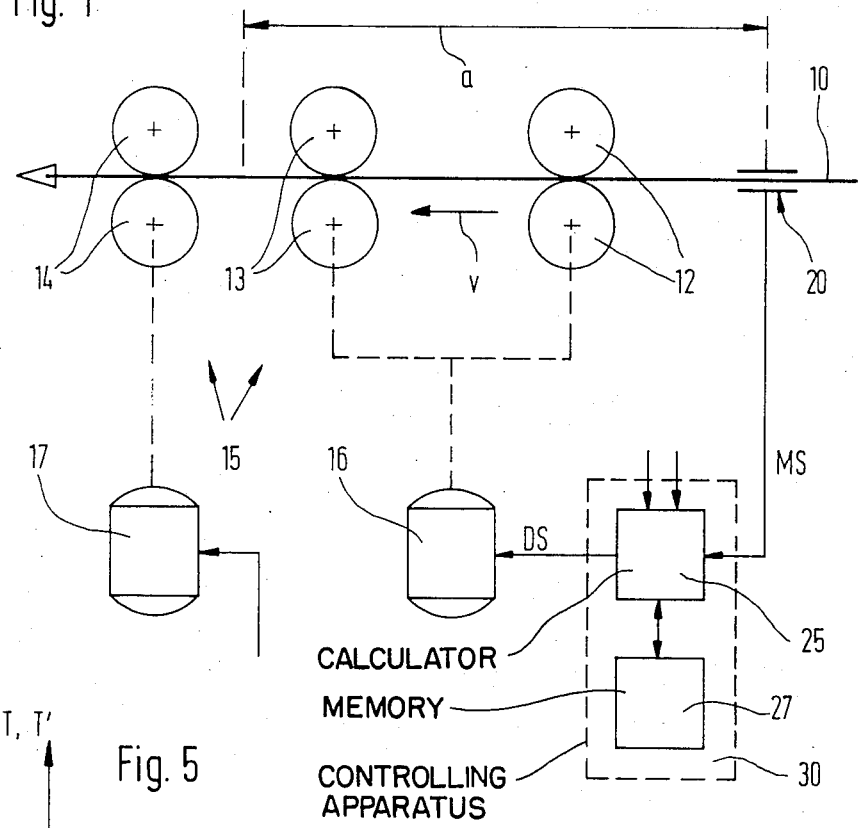
FIG. 1 is a schematic diagram of the portion of a draw frame in which the present invention is incorporated.

A draw frame such as that shown partially in FIG. 1 has, among other things, the function of imparting as uniform as possible mass characteristics to a sliver 10. In particular, the mass of the sliver 10 should change as little as possible per unit of length, that is, there should be no variations of mass in the sliver 10, if possible. To this end, the draw frame is provided with drafting means 15 which can be set in relation to the draft and with the aid of which the variations of mass of sliver 10 sensed by sensing means 20 can be compensated by changing the draft.

The drafting means 15 includes three pairs of drafting rollers 12,13,14 through which sliver 10 passes in succession. At least one of the rollers of drafting roller pairs 12,13 is driven by an electromotor 16 and at least one roller of the drafting roller pair 14 is driven by an electromotor 17. The electromotor 16 is loaded by a signal DS with the aid of which the speed of the electromotor 16 and thereby the draft can be set and changed through the speed of the drafting roller pairs 12 and 13.

The electromotor 17 is loaded by an input signal which is not designated in more detail and with the aid of which the electromotor 17 and thereby the drafting roller pair 14 can be set to a desired constant speed. The synchronism of the drafting roller pairs 12,13 determines the running speed of the sliver 10, which is indicated in FIG. 1 by an arrow. The draft of the drafting means 15 results from the quotient of the circumferential speed of the drafting roller pair 12 and of the circumferential speed of the drafting roller pair 14, and this can be changed and adjusted by the DS signal.

Sensing means 20 is located in the traveling direction of the sliver 10 in front of the drafting means 15. Variations in mass of sliver 10 are sensed by this sensing means 20. As such devices, e.g., a capacitive sensor, are well known they are not described in more detail herein.

Figure 2:
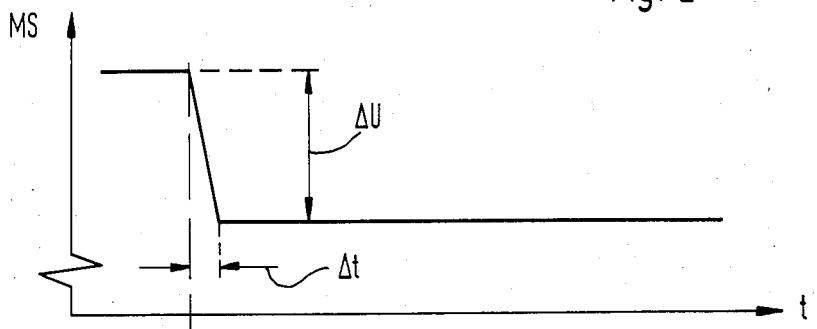
FIG. 2 is a theoretical time diagram of the output signal of the sensing means of the draw frame of FIG. 1 for sensing variations in mass characteristics of the traveling sliver.

This sensing means 20 generates an output signal MS which corresponds to the variations in mass of sliver 10. Such a signal MS is entered in FIG. 2 over the time t. The course of the signal MS, which normally constantly varies slightly, is idealized in the form of straight sections. At time T1, a sudden variation in mass occurs in the MS signal of FIG. 2, with the magnitude of the variation in mass designated in FIG. 2 by $\Delta U$ and the required time of the variation in mass by $\Delta t$. As can be seen from FIG. 1, the distance between the sensing point of the sensing device 20 and the drafting point of the drafting means 15 located between the drafting roller pairs 13 and 14 is designated by reference character a.

Controlling means 30 is provided to control the drafting portion shown in FIG. 1. This controlling means includes a calculator 25, preferably a progammable electronic microprocessor, and a memory device 27 connected to it. The signal MS of the sensing means 20 is fed to the calculator 25. Particularly, amplitudes, not designated in more detail, are fed to the calculator 25 which amplitudes correspond, for example, to the speed of the drafting roller pair 14, to the desired mass per unit of length of sliver 10, to the distance a, and from any other appropriate source. With this input, calculator 25 generates the signal DS, which controls the speed of the electromotor 16, as a function of at least these input signals.

Figure 3:
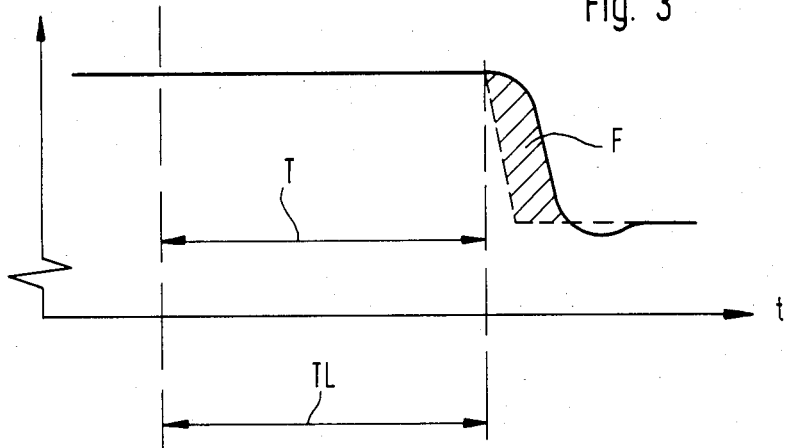
FIG. 3 is a time diagram of the draft of the drafting means of a draw frame of the prior art of FIG. 1.

FIG. 3 shows the course of the draft of the drafting means 15 under a known control according to the state of the art, entered over time t. In this control, a delay time T is waited for after the appearance of the variation in mass at time T1 which delay time extends from time T1 to a time T3. This delay time T corresponds to the travel running time TL of the sliver 10 for traveling through the distance a. The following equation represents this travel time TL: $TL=a/v$. After expiration of the delay time T, signal DS and thereby the draft of the drafting means 15 is changed in the conventional control illustrated in FIG. 3.

In order that the variation in mass of sliver 10 sensed at time T1 can be evened out, the draft of the drafting means 15 must exhibit the course shown in dotted lines in FIG. 3 and corresponding to the variation in mass of sliver 10. The draft of the drafting means 15 must therefore ideally change at time T3 in the same manner as the signal MS changed at time T1 in order to achieve thereby a complete compensation for the variation in mass which occurred. Due to the inertia of the electromotor 16, the following drafting roller pairs 12,13 and the transmission between them, such an ideal course of the draft of drafting means 15 is not possible with the prior controls. In fact, the draft of the drafting means 15 changes in the known control of FIG. 3 in accordance with the solid line. Thus, the actual course of the draft of the drafting means 15 cannot follow the desired ideal course. Rather, an error occurs which is designated in FIG. 3 by the shaded area F. The size of the area F corresponds to the magnitude of the error when the device is operated according to known control methods.

Figure 4:
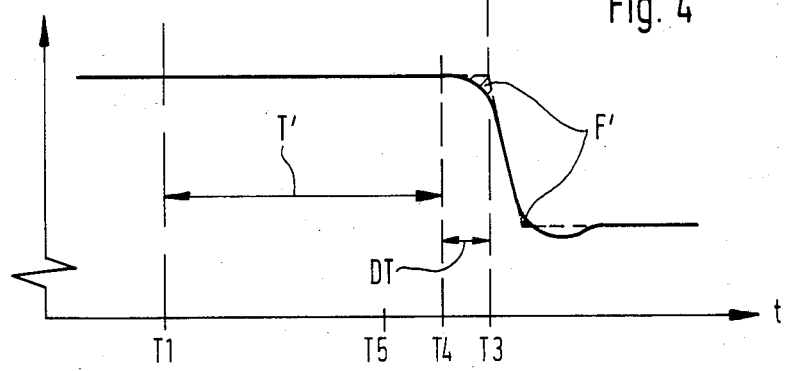
FIG. 4 is a time diagram of the draft of the drafting means of the draw frame of FIG. 1 operating in accordance with the method and means of the present invention.

In FIG. 4, which generally corresponds to FIG. 3, the course of the draft of the drafting means 15 of the device of FIG. 1 is shown, which illustrates operating according to the method and means of the present invention. In the control used in this FIG. 4, a delay time T′ is provided which extends from time T1 of the measured variation in mass to a time T4. Time T4 results from the travel time TL minus a correction time DT. The travel time TL extends, as already explained, from time T1 to time T3. The correction time DT is determined by the calculator 25 as a function of the magnitude and/or rate of the variation in mass sensed at time T1. The correction time DT is a time by which the travel time TL is shortened. Thus, the following equation is valid: $T'=TL-DT$.

Due to the shortened delay time T′, the draft of the drafting means 15 has been changed at time T4, although the variation in mass sensed at time T1 does not reach the drafting point of the drafting means 15 until time T3. The inertia of the electromotor 16, however, given a corresponding selection of correction value DT, results in an actual course of the draft of the drafting means 15 as shown in a solid line in FIG. 4, which follows the ideal course shown in dotted lines extremely precisely. This causes the error which results in FIG. 4 using the control method of the invention and shown as shaded area F′ to become extremely small.

Figure 5:
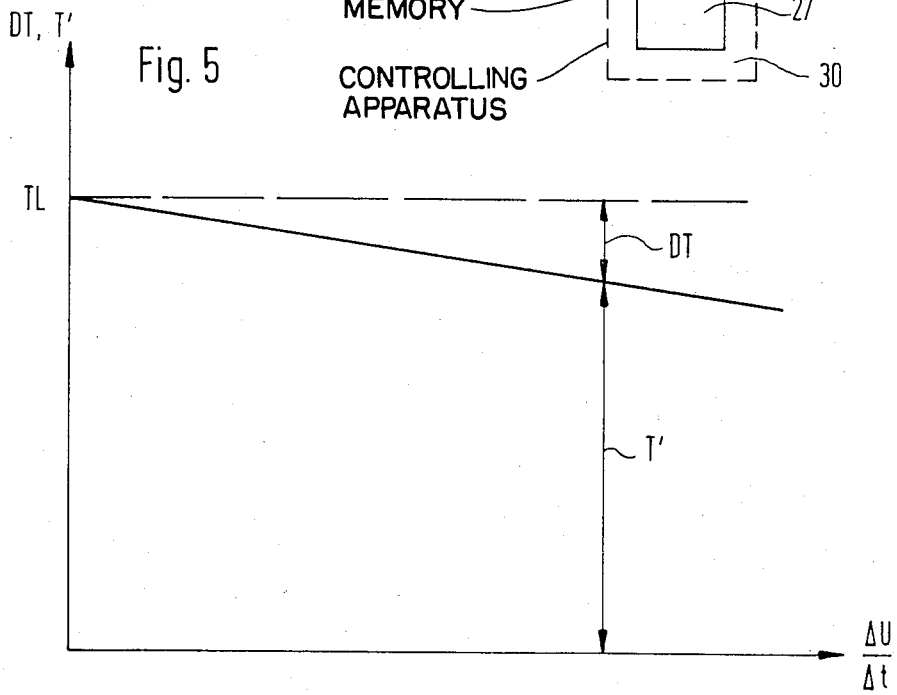
FIG. 5 is a diagram representing the correction time and the delay time as a function of the rate of the variation in mass of the sliver according to the present invention.

The correction time DT is determined by the calculator 25 as a function of its input signals, especially as a function of signal MS. To this end, the calculator 25 calculates the rate of the variation in mass sensed at time T1, that is, the value $\Delta U/\Delta t$. The greater this rate of variation in mass of sliver 10 is, the greater the correction time DT. This relation is shown in FIG. 5. In addition, FIG. 5 shows the relation between the delay time T′ and the rate of variation of the signal MS, which delay time, as has already been explained, results from the subtraction of the correction time DT from the travel time TL. The calculator 25 thus scans the course of the stored signal MS in a sweep, e.g. at time TS, and brings about a foreshortening of the travel time TL by correction time DT as a function of the rate of variation determined thereby and/or of the amplitude of the signal MS.

Instead of the linear relation between the correction value DT, the delay time T′ and the rate $\Delta U/\Delta t$ shown in FIG. 5, it is also possible to connect these magnitudes to each other by means of a function which can fall degressively, for example.

It is possible, in addition to or alternatively to the explained dependency of correction time DT and of delay time T' on the rate $\Delta U/\Delta t$ of variation of the signal MS, to determine the two specified times as a function of the relative magnitude of the variation in mass sensed at time T1. The relative magnitude of the signal MS can be derived thereby from the expression $\Delta U^x/\Delta t$, whereby x is a selectable positive number greater than 1.

For a further decrease of the regulating error shown in FIG. 1, the signal DS, which control the speed of the electromotor 16, is generated in such a manner in the control method of the invention that the rate of the change of the draft of the drafting means 15 corresponds to the rate of the variation in mass. This is achieved in that the performance data of the electromotor 16 and thereby its inertia are considered in the determining of signal DS by the calculator 25.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiment, adaptations, variations, modifications and equivalent arrangements, the present invention being limited only by the claims appended hereto and the equivalents thereof.

We claim:

1. In a method of controlling the drafting of sliver in a draw frame, which method includes sensing variation in mass characteristics of traveling sliver in advance of drawing and varying drafting in response to said sensing at a time delay related to the time of travel of sliver from the sensing to the drafting, the improvement comprising determining a correction time as a function of the characteristic of sliver mass variation sensed by said sensing and subtracting said correction time from said travel time to determine said delay time.

2. In a method according to claim 1 the improvement characterized further in that determining said correction time comprises determining said correction time as a function of the sensed rate of change of mass of sliver.

3. In a method according to claim 1 the improvement characterized further in that determining said correction time comprises determining said correction time as a function of the sensed magnitude of the change of mass of sliver.

4. In a method according to any of the claims 1, 2 or 3 the improvement characterized further by varying the rate of drafting variation in response to the magnitude of sliver mass characteristic variation sensed by said sensing.

5. In an apparatus for controlling the drafting of sliver in a draw frame, which apparatus includes means for sensing variations in mass characteristics of traveling sliver in advance of a means for drafting, means for varying said drafting means as a function of the variations in the sliver mass characteristics sensed by said sensing means and means for controlling the varying of said drafting means in response to a time delay corresponding to the time of travel of sliver from said sensing means to said drafting means, the improvement comprising said controlling means including means for determining a correction time as a function of the variation in the characteristic of sliver mass sensed by said sensing means and subtracting said correction time from said travel time to determine said delay time.

6. In an apparatus for controlling the drafting of sliver in a draw frame, controlling means according to claim 5 and characterized further in that said correction time determining means comprises means for determining the correction time as a function of the rate of change of mass of said sliver sensed by said sensing means.

7. In an apparatus for controlling the drafting of sliver in a draw frame, controlling means according to claim 5 and characterized further in that said correction time determining means comprises means for determining the correction time as a function of the magnitude of the change of mass of sliver sensed by said sensing means.

8. In an apparatus for controlling the drafting of sliver in a draw frame, controlling means according to any of claims 5, 6 or 7 and characterized further in that said controlling means includes means for varying the rate of drafting variation in response to the magnitude of sliver mass characteristic variation sensed by said sensing means.

9. In an apparatus for controlling the drafting of sliver in a draw frame, controlling means according to any of claims 5, 6 or 7 and characterized further by an electronic microprocessor that includes said correction time determining means.

10. In an apparatus for controlling the drafting of sliver in a draw frame, controlling means according to any of claims 5, 6 or 7 and characterized further by an electronic microprocessor that includes said correction time determining means, and said controlling means includes means for varying the rate of drafting variation in response to the magnitude of sliver mass characteristic variation sensed by said sensing means.

* * * * *